US005256040A

United States Patent [19]

Davis et al.

[11] Patent Number: 5,256,040

[45] Date of Patent: Oct. 26, 1993

[54] PRIMING PUMP VALVE

[75] Inventors: Stephen D. Davis, Ann Arbor; Willis E. Tupper, Pinckney, both of Mich.

[73] Assignees: Davco Manufacturing Corp., Saline; Dapco Industries, Dexter, both of Mich.

[21] Appl. No.: 959,065

[22] Filed: Oct. 9, 1992

[51] Int. Cl.[5] ..... F02M 1/16

[52] U.S. Cl. ..... 417/440; 137/569; 123/179.11

[58] Field of Search ..... 137/569, 625.47; 417/199.2, 440

[56] References Cited

U.S. PATENT DOCUMENTS

| | | | |
|---|---|---|---|
| 617,812 | 1/1899 | Leckband | 137/569 X |
| 806,268 | 12/1905 | Koontz | 137/569 |
| 1,221,532 | 4/1917 | Graf . | |
| 1,409,441 | 3/1922 | Harper | 417/440 X |
| 1,531,985 | 3/1925 | Schneiter | 417/440 |
| 1,653,853 | 12/1927 | Hill . | |
| 1,691,128 | 11/1928 | Redmond . | |
| 1,750,927 | 3/1930 | Diez | 137/569 |
| 2,118,570 | 5/1938 | Parkins et al. | 123/187.5 |
| 2,364,356 | 12/1944 | Greathouse | 123/187.5 |
| 2,373,142 | 4/1945 | Owen | 123/187.5 |
| 2,881,749 | 4/1959 | Pringham | 123/187.5 |
| 3,983,857 | 10/1976 | O'Connor | 123/187.5 R |
| 4,230,086 | 10/1980 | Lovret | 123/187.5 R |
| 4,309,968 | 1/1982 | DuBois | 123/187.5 R |
| 4,462,346 | 7/1984 | Haman et al. | 123/734 |
| 4,512,884 | 4/1985 | Wheatley | 210/136 |
| 4,660,516 | 4/1987 | Baltz et al. | 123/187.5 R |
| 5,031,590 | 7/1991 | Sakurai | 123/187.5 R |

*Primary Examiner*—Richard E. Gluck
*Attorney, Agent, or Firm*—Basile and Hanlon

[57] ABSTRACT

A priming pump valve for use in conjunction with a fuel system, such as a diesel engine, that does not result in a lag in the fuel flow during normal system operation. The priming pump valve has a control valve movable between a first position for normal operation and a second position for priming that allows for efficient priming of the fuel system when in the priming mode and unrestricted flow of fuel during normal operation of the engine.

2 Claims, 2 Drawing Sheets

PRIMING PUMP VALVE

FIELD OF THE INVENTION

The present invention generally relates to fluid transfer systems and, more particularly, is concerned with priming a fuel system for a diesel engine.

BACKGROUND OF THE INVENTION

Priming a fuel system is the act of forcing fuel through the system's lines to assure uniform pressure as well as to purge any air pockets that may exist in the system. A priming device can be critical to a system when components depend on a constant flow of fuel from the time of the system start-up. An example of such a system is the fuel system for a diesel powered combustion engine.

In a diesel engine it is important to the proper operation of the engine that the fuel transfer system be sealed against the intrusion of air. Air in the system can cause failure of the injection mechanism or improper operation of the fuel system.

In addition, a diesel engine start-up requires fuel to be in constant supply from the first crank of the engine. Otherwise, excessive wear will occur in the engine and starting system as a result of continued cranking of the high compression engine while waiting for the fuel to reach the engine's combustion chamber. Priming the diesel system is particularly important when the fuel lines are empty as a result of running out the fuel supply or changing the fuel filter. Priming methods for diesel engines and the like have been widely practiced and many types of priming devices are available to address problems such as those confronted by the aforementioned fuel system.

Priming devices for a fuel system generally follow one basic form, that being a pair of check valves in series in the fuel line with a fluid pump located thereinbetween. Both check valves normally permit fluid to flow only in the direction from the fluid source to the engine. In normal operation, the fuel is permitted to flow from the fuel source through the check valves and to the engine. When the system is in priming mode, the pump draws fluid through the check valve on the fuel source side of the line, the check valve closest to the fuel source permitting fluid to flow into the pump from its drawing action while the other check valve remains closed and not permitting the pump to draw fuel from the engine. When the pump forces the fluid between the two check valves, fluid is forced only in the direction of the engine, the check valve closest to the fluid source not permitting the fuel to be pumped toward the fuel source while the other check valve allows fuel to be pumped toward the engine. Basically, the pump draws fuel from the fuel source and pumps it toward the engine without permitting back flow to the fuel source or from the engine. This device, and other variations of it, successfully performs the priming function; however, they have serious drawbacks.

The main drawback in the aforementioned system is a lag in the fuel flow which occurs as a result of the fuel having to flow past the two check valves. This can cause a shortage of fuel to the system. The defect is more profound when the system is cold and the resulting thick fuel is less viscous. Consequently, a need exists for a priming system that does not cause a lag in the fuel system in normal operation.

SUMMARY OF THE INVENTION

The present invention provides a priming pump valve for a fuel system that does not cause a lag in the fuel flow during normal system operation. The present invention has a dual passage priming pump valve that allows for efficient priming of the fuel system when in the priming mode and unrestricted flow of fuel during normal operation. The priming pump valve has a housing with an inlet port for fuel to flow from a fuel source into the priming pump valve and an outlet port for fuel to exit the pump valve.

The priming pump valve includes a main passage communicating with the inlet and outlet ports and a control valve movable between a first position providing unrestricted flow between the inlet and outlet ports via the main passage and a second position closing said flow and connecting the inlet port to a bypass passage that, in turn, connects the inlet port to the outlet port downstream from the control valve, when the engine is in need of priming. Located at the junction of the bypass passage and the control valve is a first check valve that normally permits flow only from the inlet port via the control valve to the bypass passage. A second check valve which normally permits flow only from the bypass passage to the main passage is located downstream of the control valve at the junction of the bypass passage and the main passage. A pump connected to the bypass passage is operable to communicate fluid from the inlet port to the outlet port via the first and second check valves when the control valve is in the second position.

BRIEF DESCRIPTION OF THE DRAWINGS

The present invention is disclosed with respect to the accompanying drawings wherein like parts are referred to with like reference numerals throughout the various views, and wherein.

DESCRIPTION OF THE PREFERRED EMBODIMENT

Figure 1:
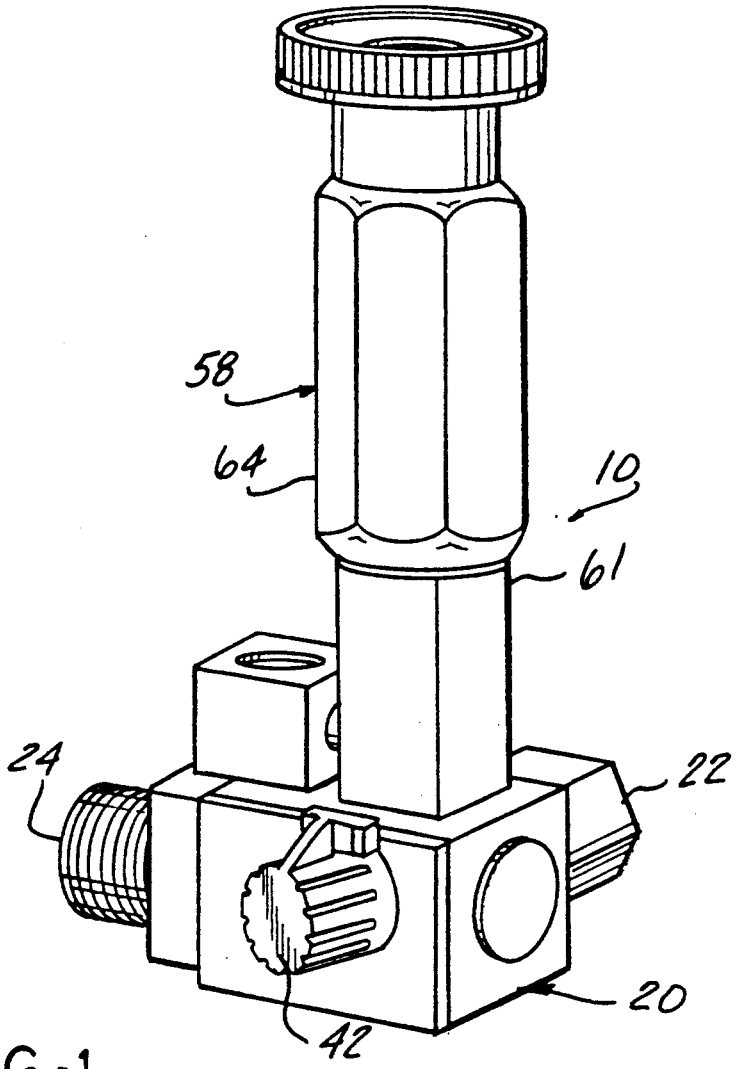
FIG. 1 is a perspective view of a preferred embodiment of the present invention in the form of a priming pump valve.

Referring to the drawings, there is illustrated one example of the present invention in the form of a priming pump valve 10 for use in a fluid system, such as in the fuel line of a diesel engine wherein fuel is communicated from a fuel tank 12 to an internal combustion engine 14 via suitable fuel lines 16 and 18. Generally, the priming pump valve 10 comprises a housing 20 having a main inlet port 22 connected to the fuel tank 12 via fuel line 18 for a fuel to flow into the priming pump valve 10 and a main outlet port 24 connected to engine 14 via fuel line 16. As can best be seen in FIG. 2, the inlet port 22 has a threaded passage 26 which is adapted to be connected to a conventional threaded connector on the end of fuel line 18. The housing 20 has a second passage 28 communicating with outlet port 24 which, in turn, has a threaded cylindrical outer surface for fastening to the fluid fuel line 16. The housing 20 has a U-shaped bypass passage 30 for fuel to flow during the priming process, all of which will be described in detail hereinafter.

Figure 2:
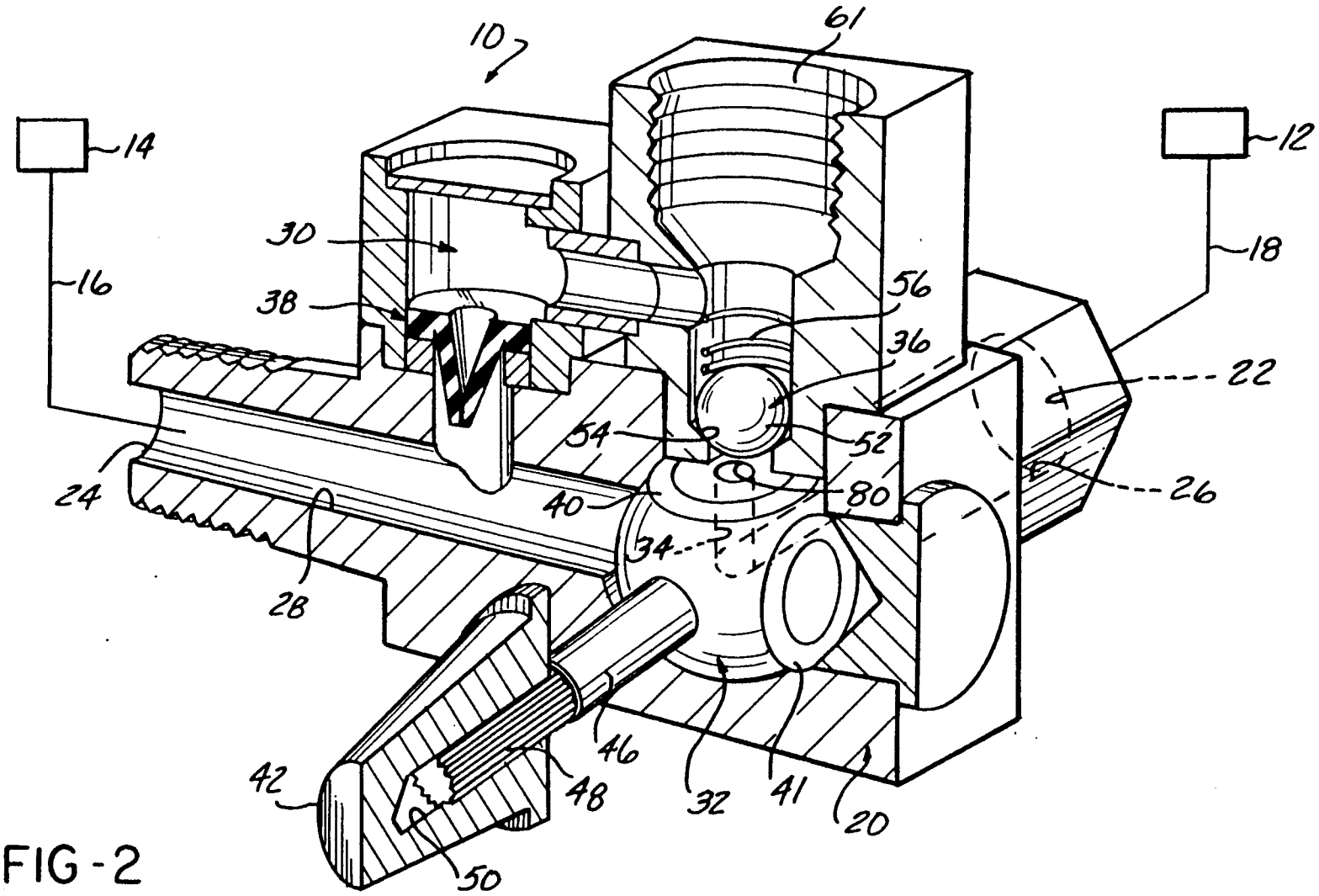
FIG. 2 is a fragmentary, perspective, cross-sectional view of the priming pump valve illustrated in FIG. 1 with the priming pump omitted.

A ball shaped control valve 32, shown in FIG. 2, is rotatably movable between a first position directly connecting the passage 26 with the passage 28 for unrestricted flow of fuel between the inlet port 22 and the outlet port 24 during a normal operating mode, and a second position connecting the passage 26 to the bypass passage 30 when it is desired to prime the engine 14. The connections are accomplished via an L-shaped valve passage 34 in control valve 32 which is in constant communication with the inlet port 22. A suitable seal, not shown, prevents fuel from leaking around ball shaped control valve 32 at the juncture of passages 26 and 34. The control valve passage 34 terminates at a sealed end which prevents leakage around the ball-shaped control valve 32. When the control valve 32 is rotated 90° to the position illustrated in FIG. 2, fuel from inlet port 22 can communicate via a first check valve 36 to bypass passage 30. When control valve 32 is rotated 90° from the position illustrated in FIG. 2, the valve passage 34 connects the inlet passage 26 directly to the outlet 24 via passage 28. The control valve 32, therefore, provides for a selected connection from inlet 22 to either the passage 28 or the passage 30 upon a 90° rotation of the control valve 32. The control valve 32 includes O-rings 40 and 41 for sealing the fluid within the path of flow when the control valve 32 is in either of the aforementioned operative positions.

The control valve 32 is actuated by a valve handle 42 connected to the control valve 32 for manually switching the control valve 32 between its first and second operative positions. The valve handle 42 is press fitted onto a shaft 46 with rib grips 48 wedged into a handle opening 50. The valve handle 42 is connected to the control valve 32 with the shaft 46 such that it is perpendicular to the control valve outlet 80 and the passage 28 to allow rotating the control valve 32 between its operative positions.

The bypass passage 30 comprises the check valve 36 and a second check valve 38 for allowing flow only in one direction, namely, from the passage 26 to the passage 28 downstream from the control valve 32 when the system is to be primed. This is accomplished, as aforementioned, with the control valve 32 in the position shown in FIG. 2 connecting the passage 26 with the bypass passage 30. The check valve 36 is located at the junction of the control valve 32 with the bypass passage 30 and only permits fluid flow from the passage 26 to the bypass passage 30. The check valve 36 is conventional in construction and comprises a ball 52 biased into engagement with a valve seat 54 by means of a spring 56. The check valve 38 is located at the junction of the bypass passage 30 and the passage 28 downstream of the control valve 32 and only permits fluid flow from the bypass passage 30 to the passage 28. While check valve 38 is illustrated as a conventional elastic-type check valve, a ball and spring arrangement similar to check valve 36 may be employed.

Figure 3:
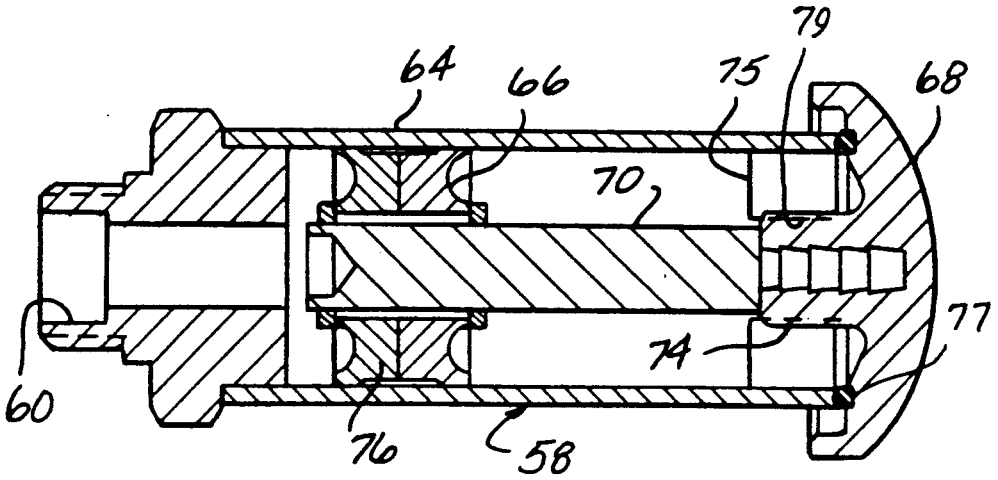
FIG. 3 is a cross-sectional view of the priming pump used in the priming pump valve of FIGS. 1 and 2.

As can best be seen in FIGS. 1 and 3, the bypass passage 30 has a manually operated hand section 58 with an opening 60 threadingly attached to the housing 20 at 61 (FIG. 2) and directly communicating with the bypass passage 30. The section 58 has a cylinder housing 64 for drawing fluid therein from bypass passage 30 when a piston 66 is retracted in the conventional manner. Reciprocation of the piston 66 within cylinder housing 64 pumps fluid through bypass passage 30. The piston 66 is reciprocated by means of a handle 68 press fitted onto a piston rod 70 carried by the piston 66. The handle 68 includes external threads 74 for threadingly engaging complementary-shaped threads 79 formed on a fixed collar 75 for locking the handle 68 to the fixed collar 75 when the section 58 is not used. An O-ring seal 77 ensures that fuel does not leak from the section 58 when not in use. The piston 66 includes C-rings 76 for efficient use and sealing of the piston 66 with the interior wall of cylinder housing 64.

In operation, the fuel flows from the tank 12 into the inlet port 22, through the passage 26 and into the control valve passage 34. When the control valve 32 is in a normal engine operating position, fuel flows through the control valve inlet passage 34 directly to the outlet port 24 via passage 28. This allows unrestricted flow of fuel from the inlet port 22 to the outlet port 24. When the control valve 32 is rotated 90° from the normal position to the priming position illustrated in FIG. 2, the control valve passage 34 is connected to the bypass passage 30 adjacent the valve seat 54. When the pump handle 68 is unfastened from threaded engagement at the external threads 74 and is withdrawn to a full-stroke position (to the right as viewed in FIG. 3) and piston 66 is moved away from opening 60, fuel is drawn from the inlet passage 26 through the control valve 32 into the bypass passage 30 via check valve 36 and into the cylinder housing 64. The fuel flow moves the ball 52 from its position on the valve seat 54, compressing the spring 56. When the handle 68 is moved to a retracted position (to the left as viewed in FIG. 3), fluid is pumped from the cylinder housing 64 through the bypass passage 30 and via check valve 38 into outlet passage 28. The check valve 36 is now in a closed position with the ball 52 seated on the valve seat 54. The check valve 36 is opened under the force of fluid from the section 58, allowing the fluid to flow from the bypass passage 30 to the outlet port 24. Continued reciprocal movement of section 58 will prime the engine 14. Upon completion of the priming mode, the pump handle 68 is moved to the retracted position as illustrated in FIGS. 1 and 3 and rotated clockwise to lockingly engage the external threads 74. The control valve 32 is rotated 90° to directly connect the inlet port 22 to the outlet port 24 via passages 26 and 28, and normal engine operation is possible.

While only one embodiment of the present invention has been disclosed, it should be understood by those skilled in the art of engines that other forms of the invention may be had, all coming within the spirit of the invention and scope of the appended claims.

What is claimed is:

1. A pump for priming a fluid flow system comprising:

a housing including an inlet port and an outlet port, a first passage communicating with said inlet port, a second passage communicating with said outlet port, a bypass passage connectable with said second passage, valve control means movable between a first position connecting said first passage with said second passage and a second position connecting said first passage with said bypass passage, a first check valve means normally permitting flow only from said valve control means to said bypass passage, a second check valve means normally permitting flow only from said bypass passage to said second passage, and means communicating with said bypass passage for translating fluid from said first passage to said second passage via said first and second check valve means when said valve control means is in said second position;

a ball member including a valve inlet port, a valve outlet port and a passage communicating between said valve inlet and valve outlet ports, said valve inlet port located generally 90° from said valve outlet port referenced from the center of said ball member and said valve inlet port being connected to said first passage of said housing, said ball member being movable about an axis located along said first passage for allowing communication of said housing inlet port with said housing outlet port via said second passage when in said first position and communication of said housing inlet port with said bypass passage when in said second position;

sealing means for allowing unrestrained rotation of said ball member and for sealing flow between said ball member and said passages; and handle means for rotating said ball member between said positions.

2. The device as defined in claim 1 wherein said means communicating with said bypass passage comprises:

a cylinder for holding said fluid;

a piston reciprocally movable within said cylinder between an extended position for drawing said fluid into said cylinder from said valve control means and a retracted position for pumping said fluid into said operational flow path; and a threaded handle for manually operating said pump piston, and complementary-shaped threads located on said cylinder for engaging said threaded handle for locking said handle in a retracted position.

* * * * *